US007021956B2

(12) United States Patent
Goto et al.

(10) Patent No.: US 7,021,956 B2
(45) Date of Patent: Apr. 4, 2006

(54) INSULATION DISPLACEMENT TERMINAL

(75) Inventors: Akira Goto, Aichi (JP); Yoshikazu Takagi, Aichi (JP); Kazushi Miyahara, Aichi (JP); Megumi Chiyoda, Aichi (JP)

(73) Assignee: J.S.T.Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/501,396

(22) PCT Filed: Nov. 21, 2002

(86) PCT No.: PCT/JP03/14897

§ 371 (c)(1),
(2), (4) Date: Jul. 15, 2004

(87) PCT Pub. No.: WO2004/049510

PCT Pub. Date: Jun. 10, 2004

(65) Prior Publication Data

US 2005/0079754 A1 Apr. 14, 2005

(30) Foreign Application Priority Data

Nov. 22, 2002 (JP) ..... 2002-339690

(51) Int. Cl.
*H01R 11/20* (2006.01)

(52) U.S. Cl. ..... 439/397

(58) Field of Classification Search ..... 439/397, 439/399, 401, 404, 407, 417
See application file for complete search history.

(56) References Cited

U.S. PATENT DOCUMENTS 5,030,132 A * 7/1991 Hayes et al. ..... 439/397
6,612,880 B1 * 9/2003 Arnett et al. ..... 439/825

FOREIGN PATENT DOCUMENTS

| | | |
|---|---|---|
| JP | 55-53882 | 4/1980 |
| JP | 75071/1986 | 5/1986 |
| JP | 62-501247 | 5/1987 |
| JP | 115257/1990 | 9/1990 |
| JP | 3-13968 | 3/1991 |
| JP | 10-214650 | 8/1998 |
| JP | 2002-100429 | 4/2002 |
| JP | 2002-134179 | 5/2002 |

* cited by examiner

*Primary Examiner*—Phuong Dinh
(74) *Attorney, Agent, or Firm*—Oblon, Spivak, McClelland, Maier & Neustadt, P.C.

(57) ABSTRACT

An insulation displacement terminal is formed entirely of an integral metal sheet. The terminal includes first and second plate-like insulation displacement groove-forming portions opposed to each other in a first direction along which an insulated wire extends. Each of the insulation displacement groove-forming portions has an insulation displacement blade of a U-shape defining an insulation displacement groove. Bottom portions of the insulation displacement groove-forming portions are interconnected by an interconnecting portion. A lead extends downwardly from one side edge of the interconnecting portion. A holding space for an insulation of the insulated wire is formed between a pair of plate portions which are formed respectively at opposite side edges of the first insulation displacement groove-forming portion by bending. Each of the plate portions has a retaining projection and a bendable piece portion.

5 Claims, 13 Drawing Sheets

INSULATION DISPLACEMENT TERMINAL

TECHNICAL FIELD

This invention relates to an insulation displacement terminal for being connected with an insulated wire by insulation displacement while displacing the insulation of the wire.

BACKGROUND ART

There is a conventional insulation displacement terminal which has double insulation displacement blades, each forming an insulation displacement groove, in order to positively effect the insulation displacement (For example, JP-A-2002-100429 and JP-A-2002-134179).

There is also a technique for an electric connector, in which an insulation displacement terminal, held within a connector housing, is connected with a wire by insulation displacement(For example, JP-A-10-214650).

When the double insulation displacement blades are used as in JP-A-2002-100429 and JP-A-2002-134179, there is encountered a problem that the size of the insulation displacement terminal becomes relatively large.

Further, in the case where the insulation displacement is conducted within the connector housing as in JP-A-10-214650, a jig for conducting the insulation displacement must be inserted into the connector housing. Therefore, a space for the insertion of the jig thereinto needs to be provided around the insulation displacement terminal within the connector housing. In addition, when the insulation displacement terminal itself is large sized, there is a fear that the electric connector becomes large in size.

Incidentally, in recent years, there has been increasingly used a technique in which connection between various ECUs (Electronic Control Unit) in vehicles, such as automobile, is made by a network.

In such a case, it may be proposed to use a connector containing insulation displacement terminals and a circuit board (to which these insulation displacement terminals are soldered) and to connect the insulation displacement terminals respectively with feed wires extending between the ECUs by insulation displacement. However, when the electric connector has a large size as described above, it is difficult to adopt this method.

DISCLOSURE OF THE INVENTION

This invention has been made in view of the above problems, and an object of the invention is to provide an insulation displacement terminal which is compact, and has a high connection reliability.

In order to solve the above problems, the invention provides an insulation displacement terminal comprising: a pair of opposed insulation displacement groove-forming portions each having an insulation displacement groove for displacing an insulation, an interconnecting portion interconnecting bottom portions of the pair of insulation displacement groove-forming portions, a lead extending from the interconnecting portion, and a pair of plate portions which are formed respectively at opposite side edges of at least one of the insulation displacement groove-forming portions by bending to form an insulated wire-holding space therebetween; and the terminal is formed into an integral construction by sheet metal working, using a single member.

In the present invention, the insulated wire is connected by insulation displacement with the insulation displacement grooves of the insulation displacement groove-forming portions in a double manner while the insulation of the wire is displaced by these insulation displacement grooves, and therefore reliability can be enhanced. And besides, the plate portions are formed respectively at the opposite side edges of the insulation displacement groove-forming portion by bending to provide the holding space for the insulated wire, and therefore the overall length of the terminal as well as its width can be made much smaller.

Further, the terminal further comprises abutment portions formed respectively at lower edges of the plate portions so as to abut against a housing, and bendable piece portions extending respectively from upper edges of the plate portions.

In the invention, by bending the bendable piece portions, the insulated wire can be confined and held in the holding space defined by the housing and the pair of plate portions. Therefore, this portion can be formed into a compact structure as compared with a conventional insulation barrel of a generally trough-shape.

Further, in the terminal, each of the plate portions includes a retaining portion for retaining engagement with the housing.

In the invention, when bending the bendable piece portions, the plate portions will not be displaced out of position, so that the insulation of the insulated wire can be positively held.

Further, the terminal comprises retaining portions which are formed respectively on opposite side edges of the pair of insulation displacement groove-forming portions so as to be retainingly engaged with the housing.

In the invention, the insulation displacement groove-forming portions can be firmly joined to the housing, and an insulation displacement load, produced when carrying out the insulation displacement operation within the housing, can be more positively received by the housing.

Further, the terminal comprises a bent portion which is provided at an intermediate portion of the lead, and is resiliently deformable.

In the invention, during the time when the insulation displacement operation is carried out, for example, within the housing, the bent portion is deformed, and therefore the insulation displacement load is prevented from inadvertently acting on a solder portion at the distal end of the lead and other portions. Therefore, this is quite suited for the insulation displacement within the housing.

Figure 1:
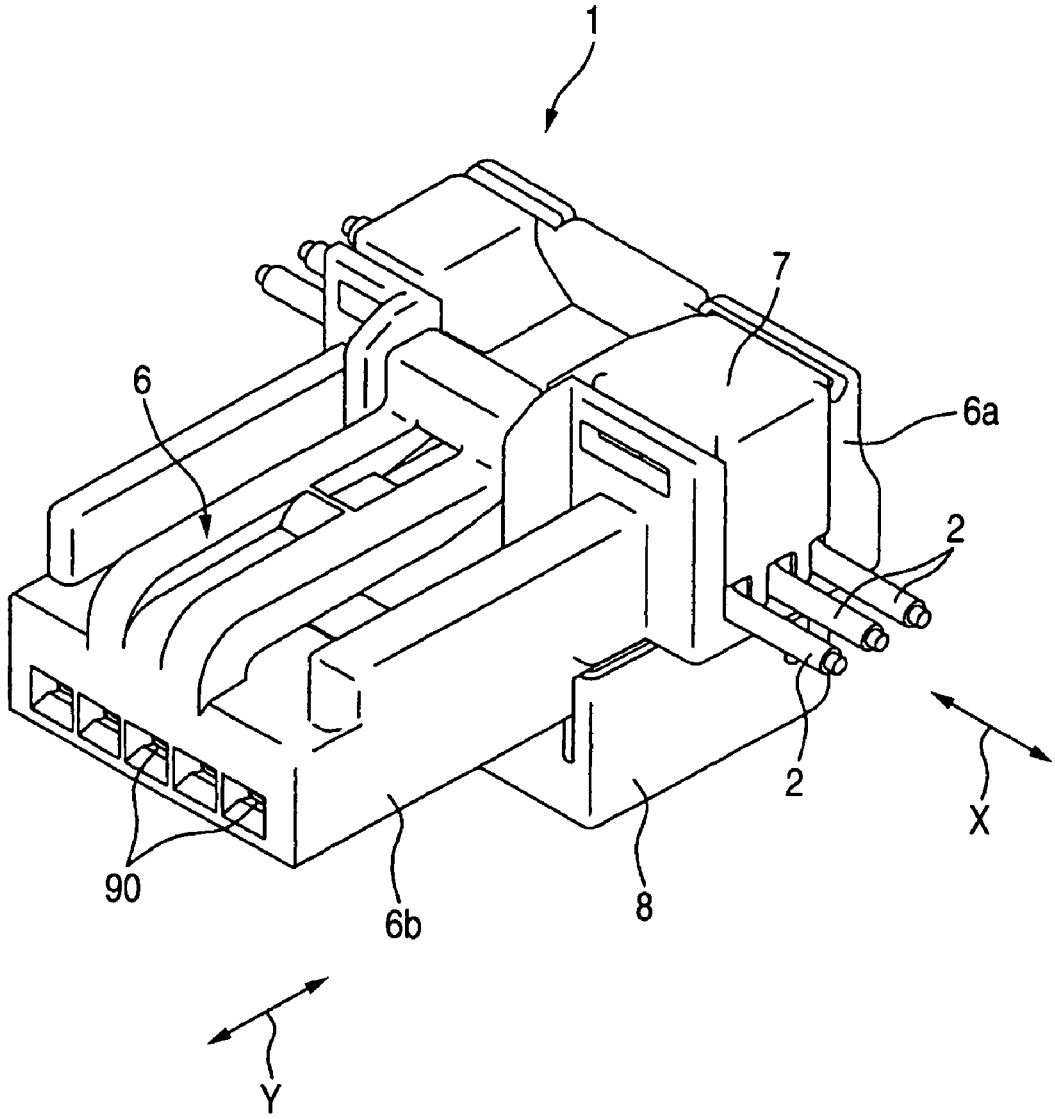
FIG. 1 is a schematic perspective view of a board-containing insulation displacement connector including one preferred embodiment of insulation displacement terminals of the present invention.

Referring to reference numerals and signs in the drawings, 1 denotes the board-containing insulation displacement connector, 2 the insulated wire, 3 and 3A the insulation displacement terminal (insulation displacement terminal), 4 a body, 5 the terminal holding portion, 6 the main housing, 7 a first cover housing, 8 the second cover housing, 9 a first holding space, 10 the circuit board, 10*a* a first surface, 10*b* a second surface, 11 a second holding space, 12 the lead, 12*a* a distal end, 13 a bottom plate, 14 a passage hole, 71 a first insulation displacement groove-forming portion, 72 a second insulation displacement groove-forming portion, 73 an insulation displacement groove, 74 an insulation displacement blade, 75 an interconnecting portion, 76 and 77 retaining projections (retaining portions), 78 and 79 plate portions, 78*a* and 78*b* lower edges, 78*b* and 79*b* upper edges, 80 a retaining projecton (retaining portion), 81 a bendable piece portion, 82 a reinforcing flange, 83 and 84 vertical grooves, 85 a retaining hole, R the holding space, and B a bent portion.

BEST MODE FOR CARRYING OUT THE INVENTION

A preferred embodiment of the present invention will now be described with reference to the accompanying drawings.

Figure 2:
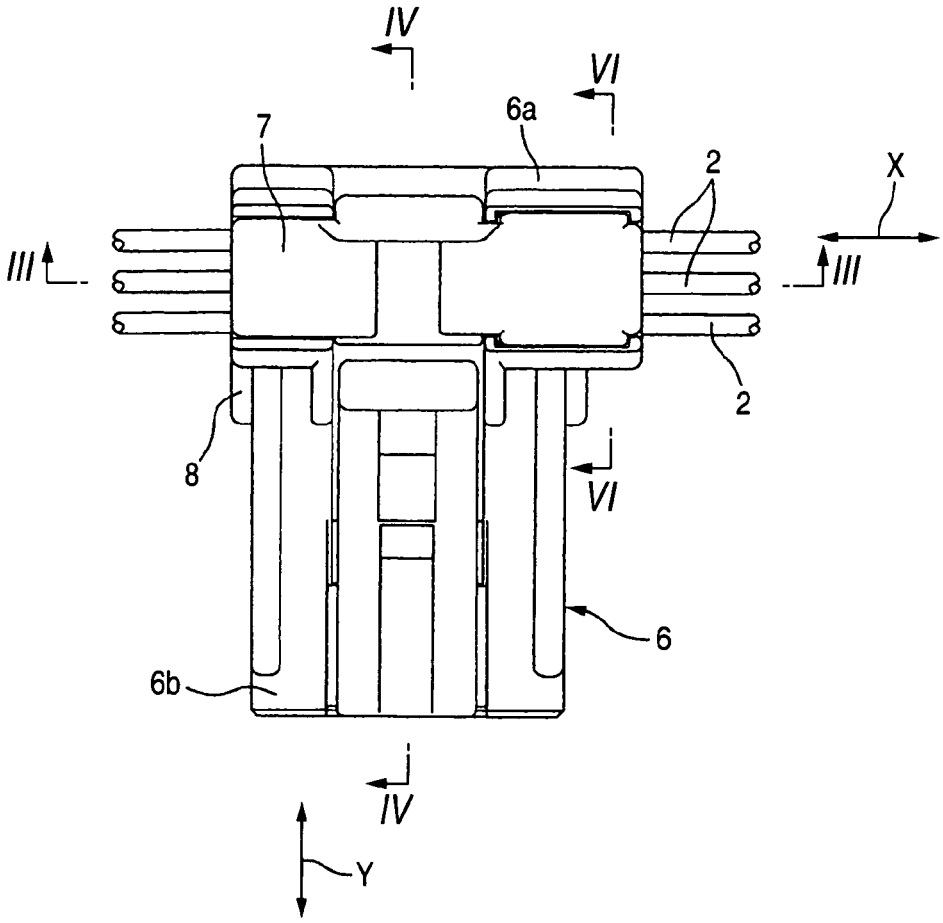
FIG. 2 is a plan view of the board-containing insulation displacement connector.
Figure 3:
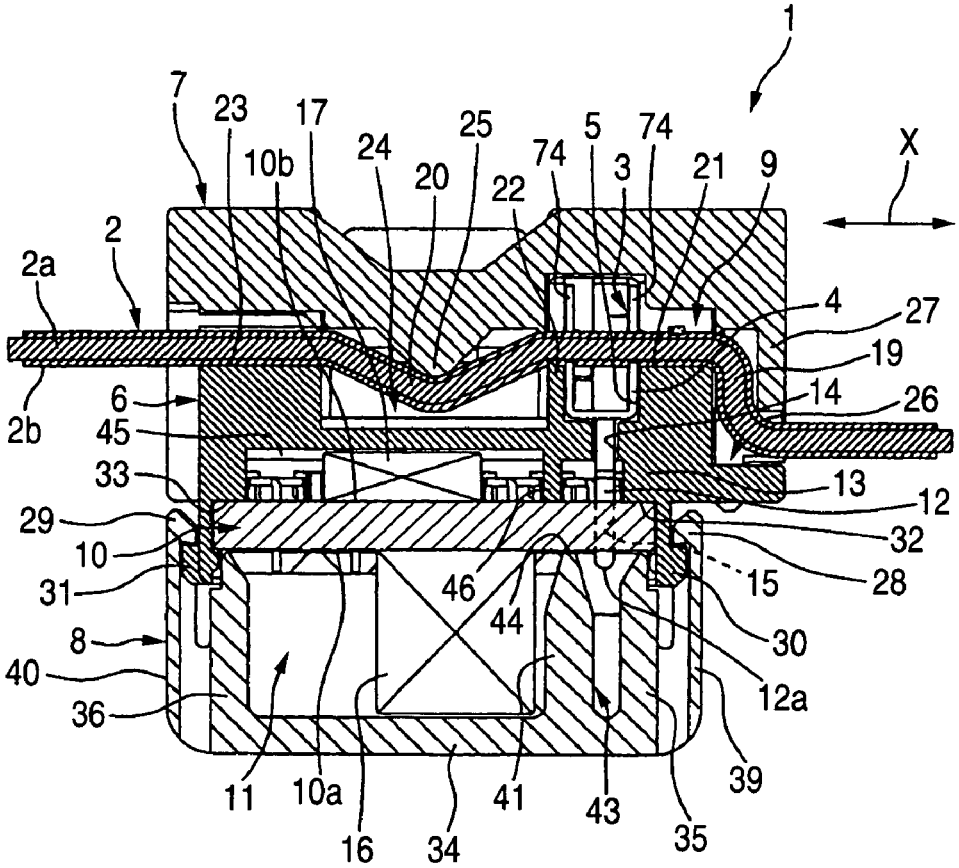
FIG. 3 is a cross-sectional view taken along the line III—III of FIG. 2.
Figure 4:
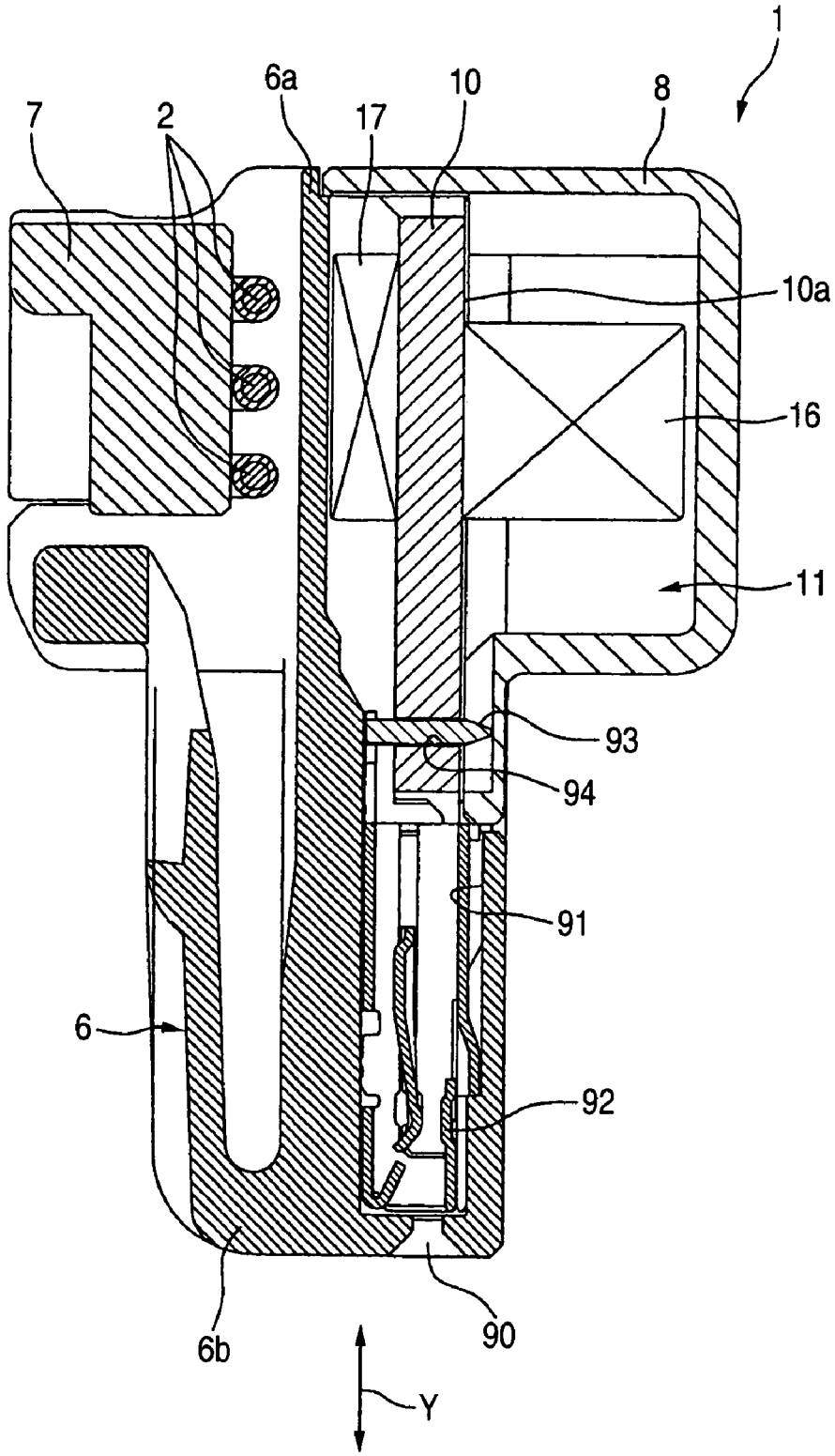
FIG. 4 is a cross-sectional view taken along the line IV—IV of FIG. 2.

FIG. 1 is a schematic perspective view of a board-containing insulation displacement connector including one preferred embodiment of insulation displacement terminals of the invention, and FIG. 2 is a plan view of the board-containing insulation displacement connector. FIG. 3 is a cross-sectional view taken along the line III—III of FIG. 2, and FIG. 4 is a cross-sectional view taken along the line IV—IV of FIG. 2.

Referring to FIGS. 1, 2 and 3, the board-containing insulation displacement connector 1 (hereinafter also referred to merely as "connector 1") comprises a plurality of insulation displacement terminals 3 (hereinafter referred to merely as "insulation displacement terminals 3"). In FIG. 3, only one insulation displacement terminal 3 is shown). for being connected by insulation displacement respectively with intermediate portions of a plurality of insulated wires 2 (serving as feed wires extending in a first direction X) while displacing their respective insulations, a main housing 6 having a terminal holding portion 5 for holding bodies 4 of the insulation displacement terminals 3, and first and second cover housings 7 and 8 combined respectively with opposite sides (for example, upper and lower sides) of the main housing 6.

Referring to FIG. 1, the main housing 6 includes a first portion 6*a* extending in the first direction X, and a second portion 6*b* extending in a second direction Y perpendicular to the first direction X. A plurality of juxtaposed ports 9 are disposed in an end portion of the second portion 6*b* of the main housing 6. As shown in FIG. 4, female terminals 92 (to which corresponding male terminals, press-fastened respectively to end portions of wires (not shown), are adapted to be connected, respectively) are received and held respectively in receiving recesses 91 disposed inwardly respectively of the ports 90. A lead 93, formed at one end of each female terminal 92, passes through a passage hole 94 formed through a circuit board 10, and is soldered to a conductive portion on a first surface 10*a* of the circuit board 10, and therefore is electrically connected to the circuit board 10.

Referring to FIG. 3, a first holding space 9 for holding the insulation displacement terminals 3 and required portions of the insulated wires 2 is formed between the first portion 6*a* of the main housing 6 and the first cover housing 7 combined with this main housing. A second holding space 11 for the circuit board 10 is formed between the main housing 6 and the second cover housing 8 which are combined together.

A lead 12 extends from the body 4 of the insulation displacement terminal 3. This lead 12 passes through a passage hole 14 in a bottom plate 13 of the main housing 6, and extends into the second holding space 11, and further passes through a passage hole 15 in the circuit board 10, and is soldered at its distal end to a conductive portion on the first surface 10*a* of the circuit board 10.

Referring to FIGS. 3 and 4, reference numerals 16 and 17 denote components, such as capacitors, mounted on the first and second surfaces 10*a* and 10*b* of the circuit board 10.

Referring to FIG. 3, in the condition in which the main housing 6 and the first cover housing 7 are combined together, the insulated wires 2 extend through the first holding space 9 along the first direction X. Within the first holding space 9, the intermediate portion of each insulated wire 2 is connected by insulation displacement with insulation displacement blades 74 of the body 4 of the corresponding insulation displacement terminal 3. The insulated wire 2 has first and second bent portions 19 and 20 which are bent at opposite sides (in the first direction X) of the body 4 of the insulation displacement terminal 3 by corresponding projecting portions of the first cover housing 7, respectively.

More specifically, the main housing 6 includes first, second and third wire holding portions 21, 22 and 23 of the same height which are juxtaposed in the first direction X. The wire holding portions 21, 22, 23 have, for example, a groove-like form, and are provided in a plural number corresponding to the number of the wires. The second and third wire holding portions 22 and 23 are disposed at that side of the terminal holding portion 5 facing away from the first wire holding portions 21 in the first direction X. The main housing 6 has a recess 24 disposed between the second and third wire holding portions 22 and 23, and a convex portion 25, corresponding to the recess portion 24, is formed on the first cover housing 7. That portion of each insulated wire 2, lying between the second and third wire holding portions 22 and 23, is pressed into the recess 24 by the convex portion 25, and therefore is bent to form the second bent portion 20.

The main housing 6 has a recess 26 disposed outwardly of the first wire holding portion 21 in the first direction X, and the first cover housing 7 has an end wall 27 corresponding to the recess 26. That portion of each insulated wire 2, extending outwardly from the first wire holding portion 21, is pressed into the recess 26 of the main housing 6 by the end wall 27 of the first cover housing 7, and therefore is bent into a crank-like shape, and this crank-like bent portion forms the first bent portion 19.

Figure 5:
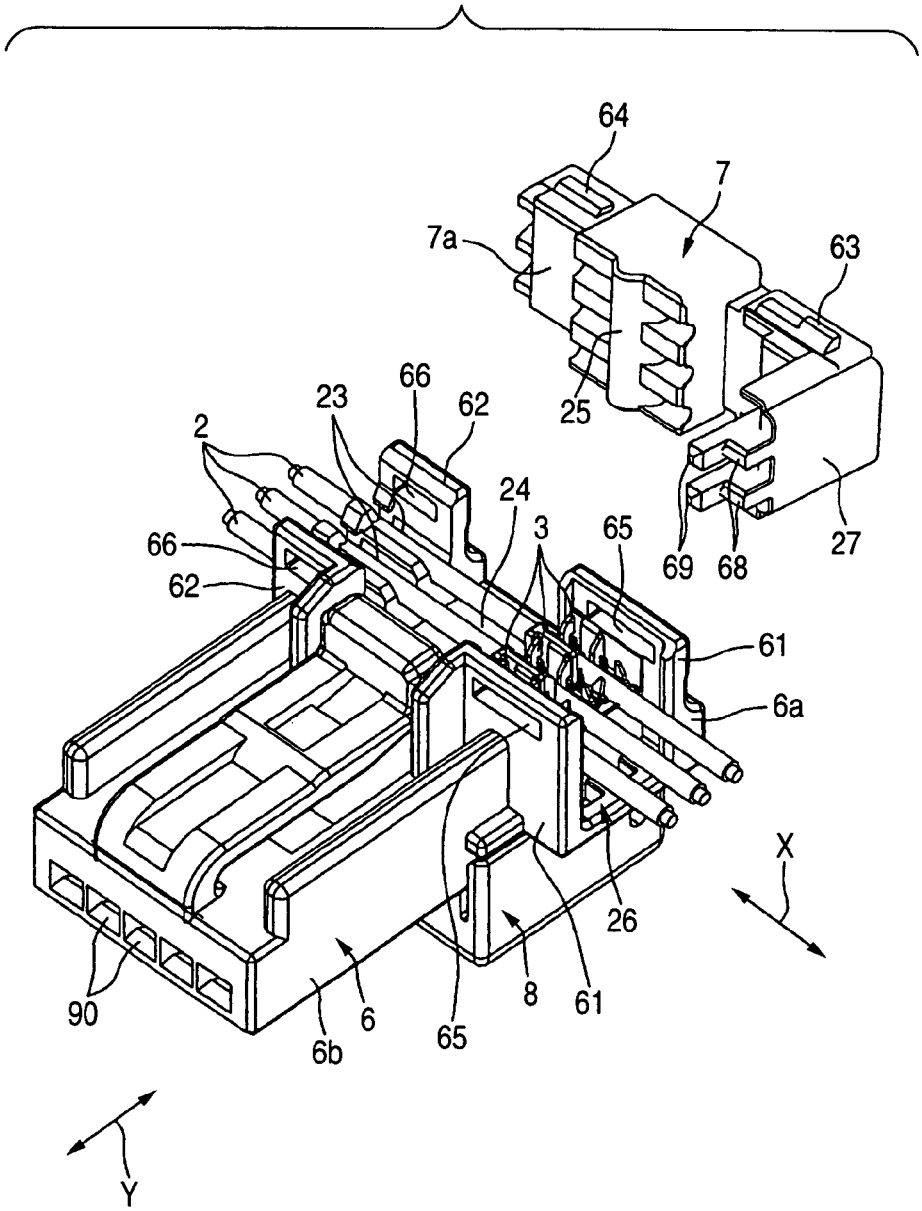
FIG. 5 is an exploded, perspective view of the board-containing insulation displacement connector.

Referring to FIG. 5 which is an exploded perspective view, a pair of wall portions 61 and a pair of wall portions 62 (each pair of walls are opposed to each other in the second direction Y) are formed on the first portion 6*a* of the main housing 6, and engagement portions (for example, defined respectively by engagement grooves) 65, 66 (in which hooks 63, 64, formed respectively on side surfaces of the first cover housing 7, can be hookingly engaged, respectively) are formed respectively in the wall portions 61, 62.

The convex portion 25, formed on the lower surface of the first cover housing 7, presses the relevant portions of the insulated wires 2 into the recess 24, with these hooks 63 and 64 hookingly engaged respectively in the corresponding engagement portions 65 and 66. For example, a pair of first projections 67 and, for example, a pair of second projections 68 (which project in a larger amount than the first projections 67, and serve as a pair of interconnecting means) are formed on and project from the end wall 27 of the first cover housing 7.

Figure 6:
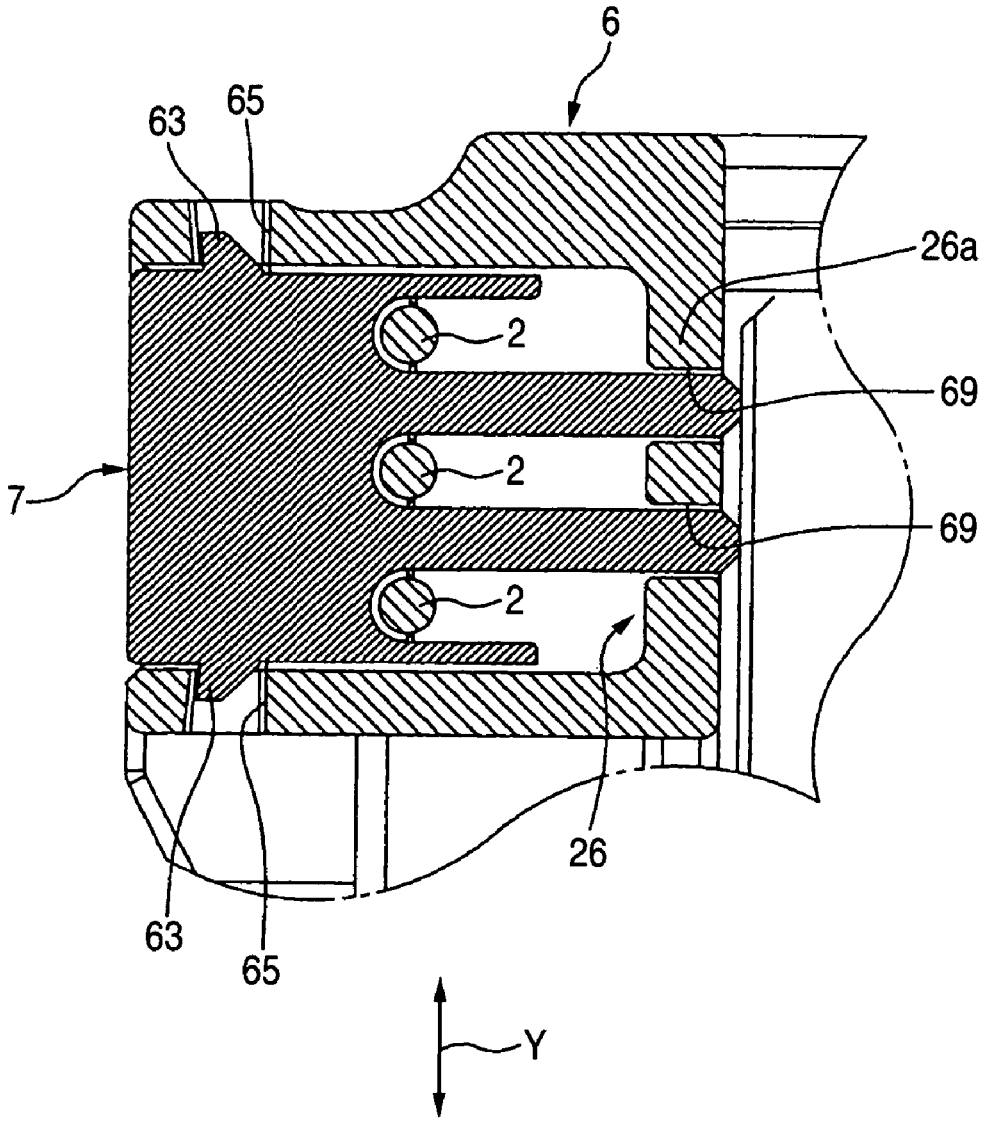
FIG. 6 is a cross-sectional view taken along the line VI—VI of FIG. 2.

When the first cover housing 7 is combined with the main housing 6, each of the two first projections 67 is inserted between the adjacent insulated wires 2, and abuts against a bottom wall 26*a* of the recess 26 of the main housing 6, and also the pair of second projections 68 are fitted respectively in fitting portions 69 (which are defined respectively by fitting holes formed through the bottom wall 26*a* of the recess 26 of the main housing 6, and serve as a pair of corresponding interconnecting means) as shown in FIG. 6 which is a cross-sectional view taken along the line VI—VI of FIG. 2.

By this fitting connection, the end wall 27 of the first cover housing 7 is firmly connected to the main housing 6, and therefore even if an external pulling load acts on the insulated wires 2, this connection will not be canceled. This prevents the so-called turning-up of the end wall 27 of the first cover housing 7.

Referring again to FIG. 3, a pair of engagement portions 30 and 31 (with which a pair of hooks 28 and 29 of the second cover housing 8 can be hookingly engaged, respectively) are formed on and project from opposite end portions (in the first direction X) of the bottom plate 13 of the main housing 6, respectively. The bottom plate 13 of the main housing 6 has a pair of abutment portions 32 and 33 which are formed adjacent respectively to the engagement portions 30 and 31 so as to abut respectively agan inst a pair of end portions of the second surface 10*b* of the circuit board 10.

Figure 7:
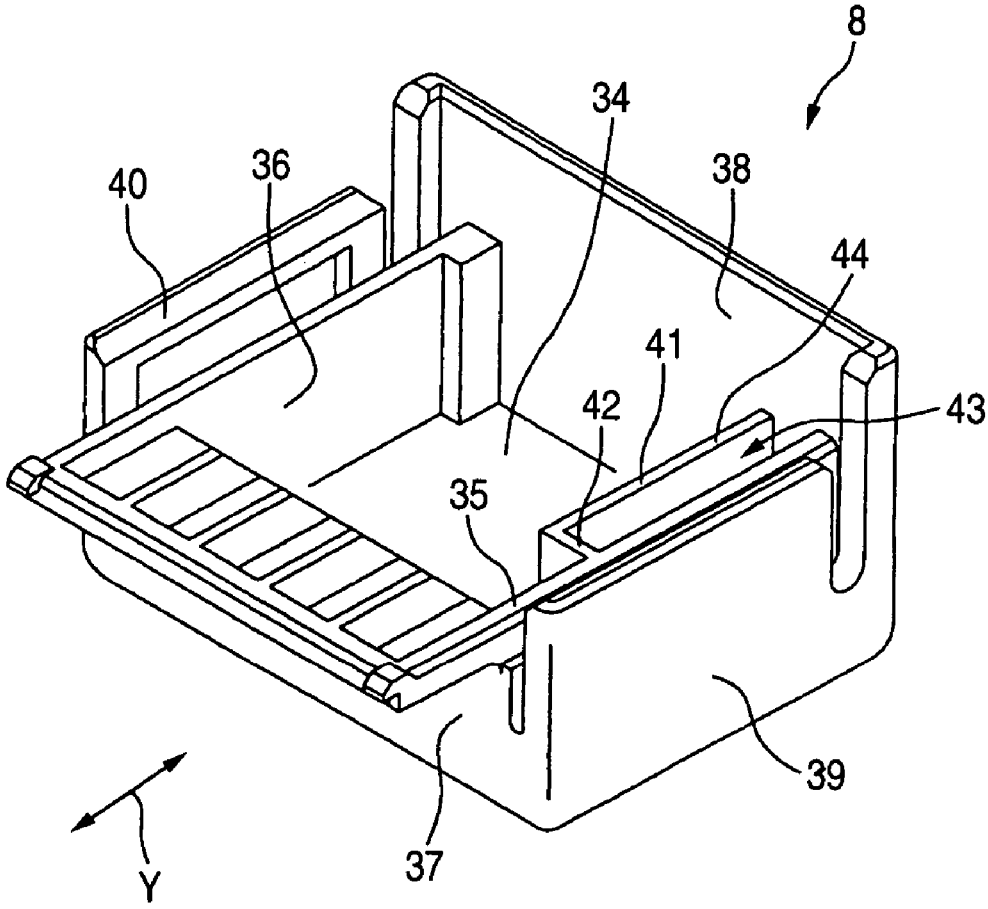
FIG. 7 is a perspective view of a second cover housing.

As shown in FIG. 7, the second cover housing 8 includes a bottom wall 34 of a rectangular shape, and first, second, third and fourth side walls 35, 36, 37 and 38 formed at a peripheral edge of the bottom wall 34. Outer walls 39 and 40 are provided outwardly of the first and second side walls 35 and 36, respectively, and the hooks 28 and 29 are formed respectively at ends of the outer walls 39 and 40 as shown in FIG. 3.

Referring to FIG. 7, a rib 41 parallel to the first side wall 35, as well as a rib 42 parallel to the third side wall 37, is formed on and extends upwardly from the bottom plate 34. These ribs 41 and 42, the first side wall 35 and the fourth side wall 38 jointly form a box-like portion 43 which is excellent in strength, and a receiving portion 44 for receiving an insulation displacement load (described later) via the circuit board 10 is provided at this box-like portion 43. The receiving portion 44 is formed by end edges of the first side wall 35 and ribs 41 and 42, and abuts agan inst the first surface 10*a* of the circuit board 10 as shown in FIG. 3. Distal ends 12*a* of the leads 12 of the insulation displacement terminals 3 extend through that portion of the circuit board 12 disposed within the region of the box-like portion 43.

Referring to FIG. 3, the end of each of the first and second side walls 35 and 36 (spaced from each other in the first direction X) cooperates with the corresponding abutment portion 32, 33 of the main housing 6 to hold the corresponding end portion of the circuit board 10 therebetween.

A recess 45 for receiving a group of circuit components (including the circuit component 17) mounted on the second surface 10*b* of the circuit board 10 is formed in the bottom plate 13 of the main housing 6, and a rib 46 for abutment agan inst the second surface 10*b* of the circuit board 10 is formed perpendicularly on a portion of the recess 45. This rib 46 is disposed at a position generally corresponding to the rib 41 of the second cover housing 8, and the circuit board 10 can be held between the two ribs 46 and 41.

Figure 8:
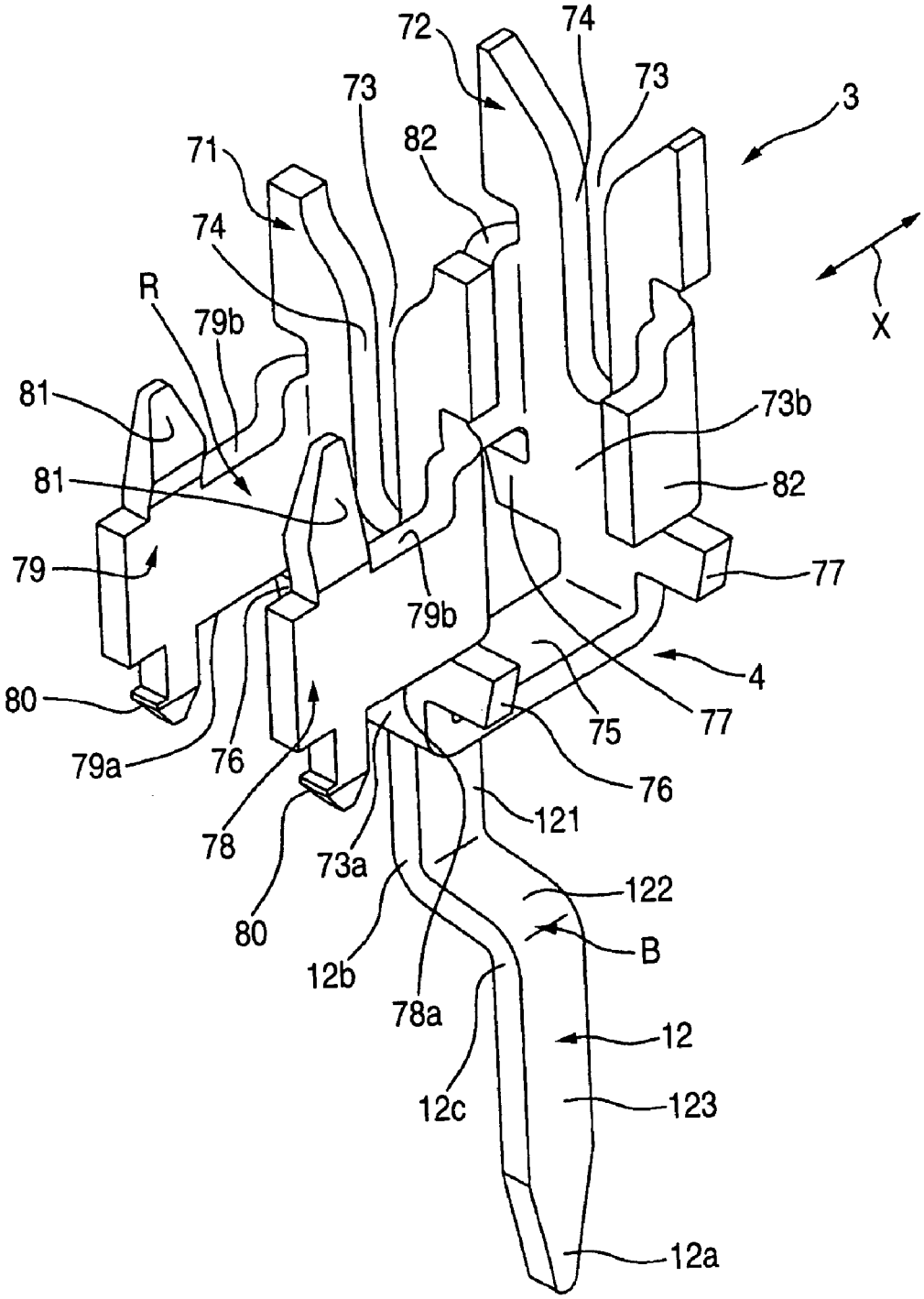
FIG. 8 is a perspective view of the insulation displacement terminal.

Referring to FIG. 8, the whole of the insulation displacement terminal 3 is formed by sheet metal working, using a single metal sheet. The body 4 of the insulation displacement terminal 3 includes first and second plate-like insulation displacement groove-forming portions 71 and 72 opposed to each other in the first direction X. Each of the insulation displacement groove-forming portions 71 and 72 has the insulation displacement blade 74, for example, of a generally U-shape defining an insulation displacement groove 73.

Figure 9:
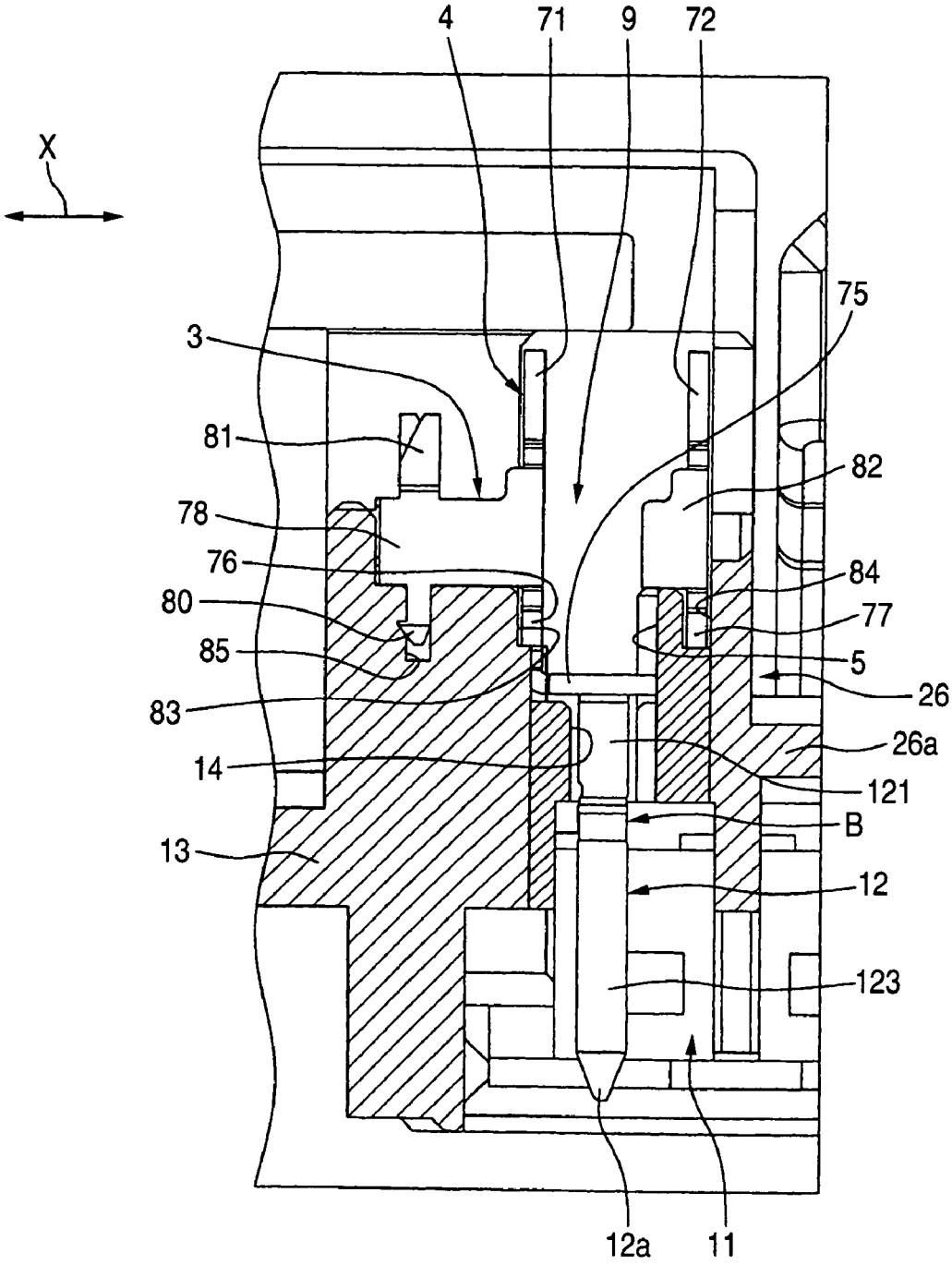
FIG. 9 is a schematic cross-sectional view of an important portion of the board-containing insulation displacement connector, showing a condition in which the insulation displacement terminals are held on a terminal holding portion of a main housing.

Bottom portions 73*a* and 73*b* of the first and second insulation displacement groove-forming portions 71 and 72 are interconnected by an interconnecting portion 75. Retaining projections 76, 77, serving as retaining portions for retaining engagement with the terminal holding portion 5 of the main housing 6, are formed respectively at opposite side edges of the bottom portion 73*a*, 73*b* of each of the first and second insulation displacement groove-forming portions 71 and 72, and project laterally therefrom. As shown in FIG. 9, the retaining projections 76, 77 are press-fitted respectively in corresponding vertical grooves 83, 84 formed in the terminal holding portion 5 of the main housing 6, and are retained therein.

Referring again to FIG. 3, a pair of plate portions 78 and 79 are formed respectively at opposite side edges of the first insulation displacement groove-forming portion 71 by bending. The plate portions 78 and 79 serve to form a holding space R (for the insulated wire 2) therebetween.

Lower edges 78*a* and 79*a* of the plate portions 78 and 79 can abut agan inst a bottom portion 5*a* of the terminal holding portion 5 to be received by this bottom portion. Retaining projections 80 (for example, of a hook-like shape), serving as retaining portions for retaining engagement with the terminal holding portion 5 of the main housing 6, are formed on and project downwardly from the lower edges 78*a* and 79*a* of the plate portions 78 and 79, respectively. As shown in FIG. 9, each retaining projection 80 is inserted into a corresponding retaining hole 85 formed in the terminal holding portion 5 of the main housing 6, and is hookingly retained therein.

Referring again to FIG. 3, a bendable piece portion 81 is formed on and projects upwardly from an upper edge 78*b*, 79*b* of each of the plate portions 78 and 79. These bendable piece portions 81 can be bent inwardly toward each other so as to confine the insulated wire 2 in the holding space R. More specifically, the holding space R is defined by a relevant portion 5*b* of the terminal holding portion 5 of the main housing 6, the pair of plate portions 78 and 79 and the bent bendable piece portions 81.

The lead 12 extends downwardly from one side edge of the interconnecting portion 75, and includes a crank-like bent portion B (serving as a deformable portion) provided at its intermediate portion. More specifically, the lead 12 includes a first portion 121 bent generally perpendicularly at the interconnecting portion 75 to extend downwardly, a second portion 122 bent generally perpendicularly at a bent portion 12*b* to extend generally laterally from the first portion 121, and a third portion 123 bent generally perpendicularly at a bent portion 12*c* to extend downwardly from the second portion 122. The bent portion B is formed by the second portion 122, the two bent portions 12*b* and 12*c*, and their neighboring portions.

Figure 10:
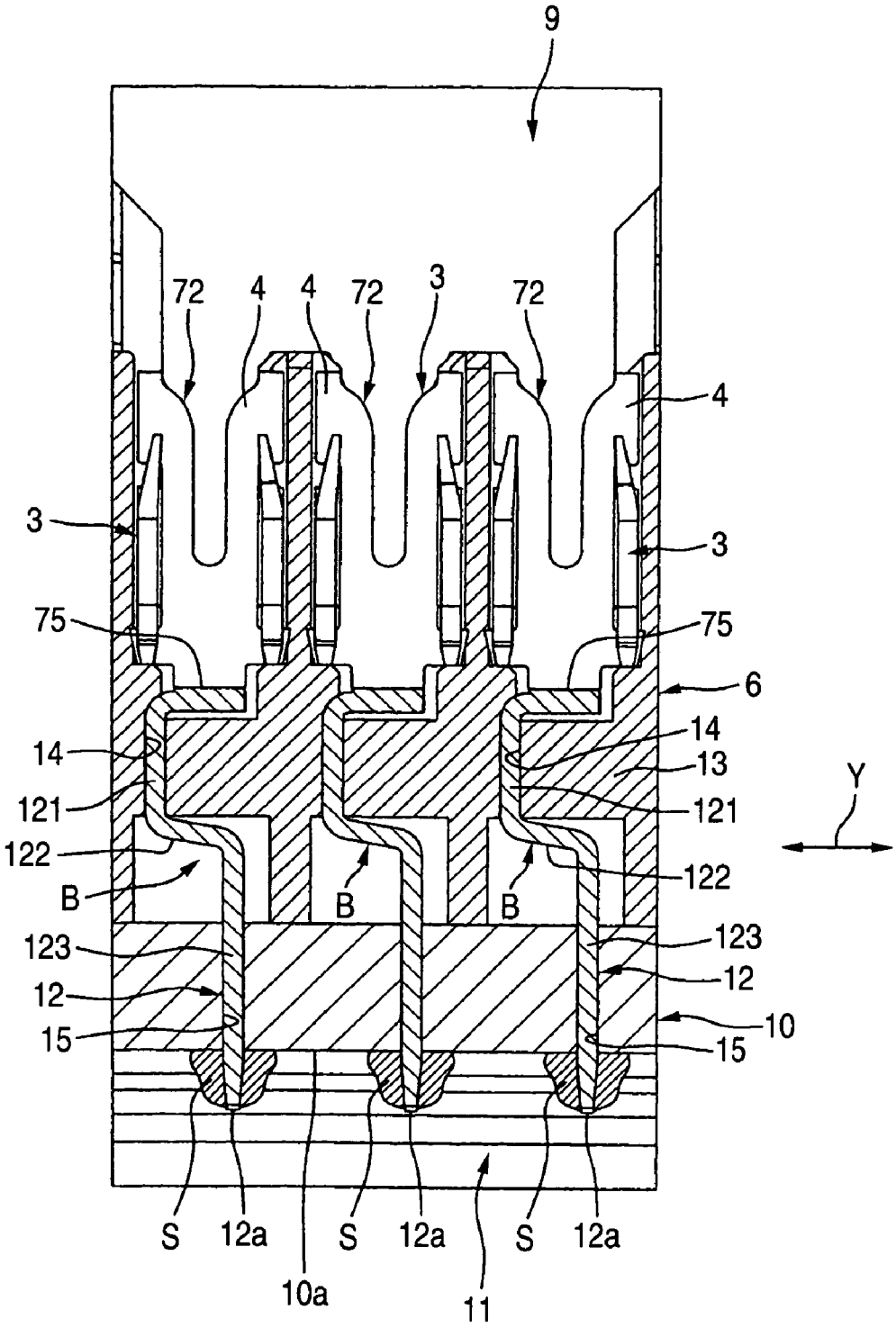
FIG. 10 is a schematic cross-sectional view of an important portion of the board-containing insulating displacement connector, showing a condition in which leads of the insulation displacement terminals, held on the terminal holding portion of the main housing, are soldered to a circuit board.

As shown in FIG. 10, the first portion 121 is passed through the passage hole 14 in the main housing 6, and the third portion 123 is passed through the passage hole 15 in the circuit board 10. The bent portion B is disposed between the bottom plate 13 of the main housing 6 and the circuit board 10, and can be deformed during the insulation displacement, thereby preventing an insulation displacement load from being transmitted to a solder portion S provided at the distal end 12*a* of the lead 12.

Figure 11:
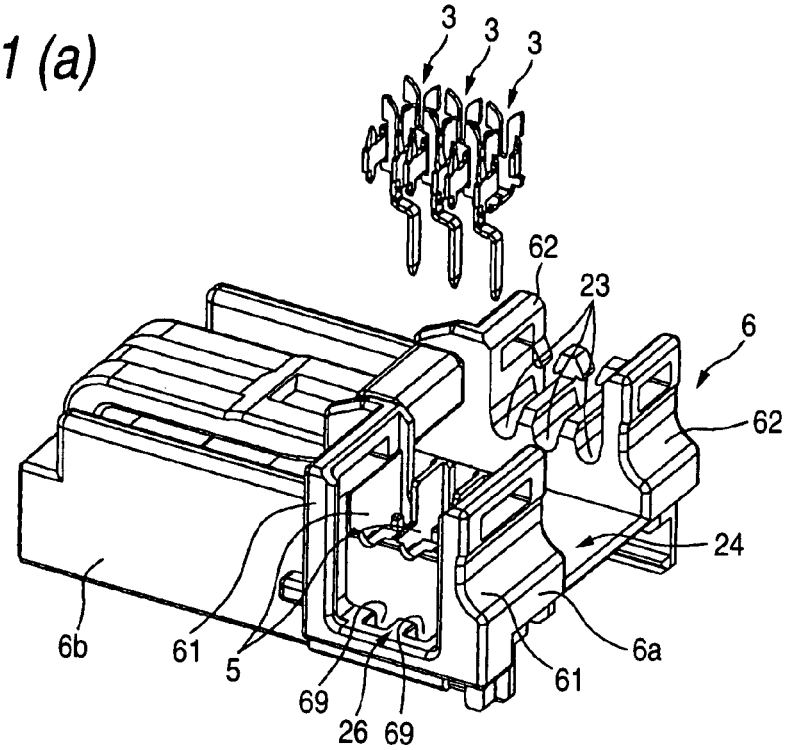
FIG. 11(*a*) and FIG. 11(*b*) are perspective views showing the process of mounting the insulation displacement terminals.
Figure 11:
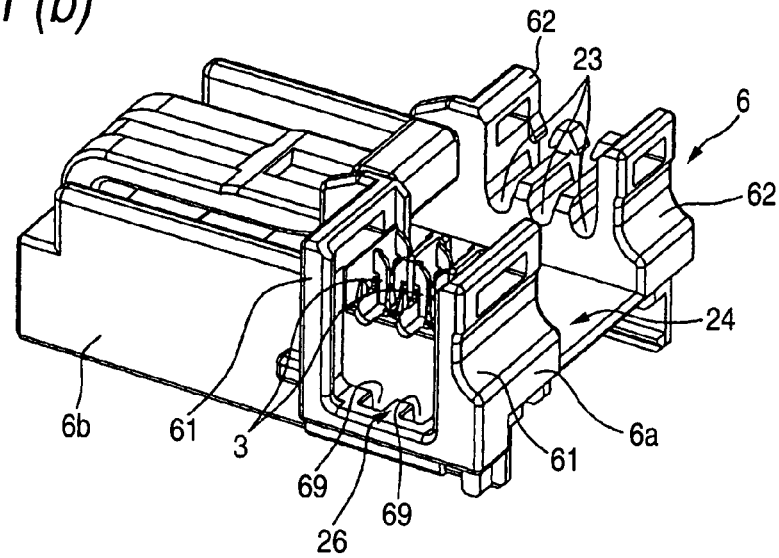
Figure 12:
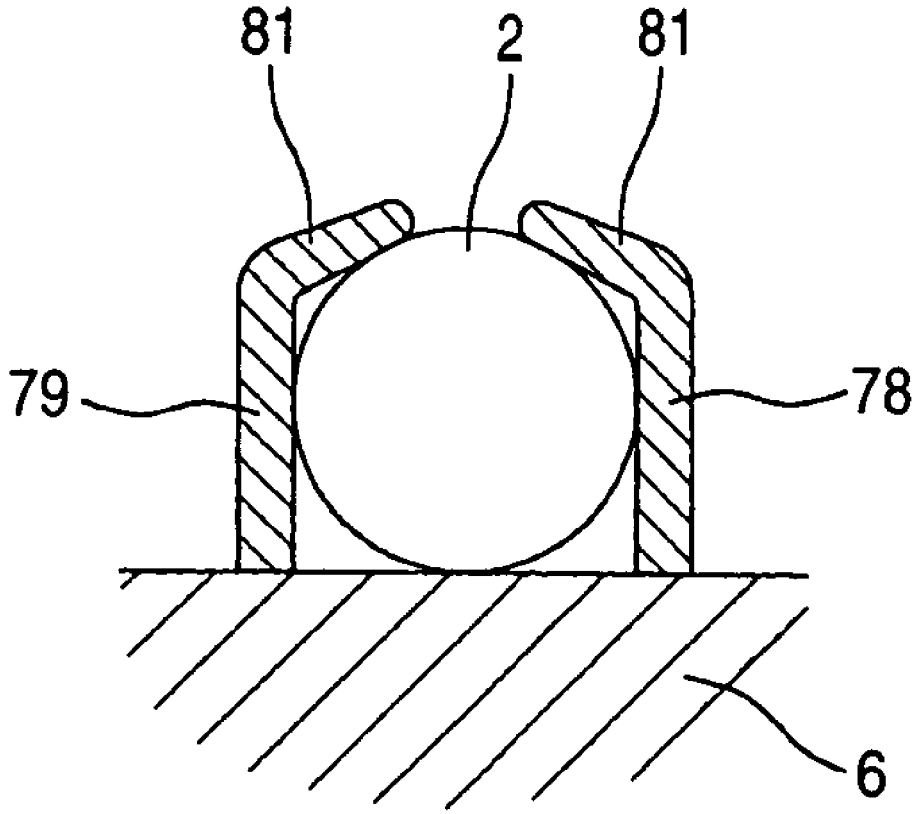
FIG. 12 is a schematic cross-sectional view of an important portion of the insulation displacement terminal, showing a condition in which the insulation of an insulated wire is received in a holding space.
Figure 13:
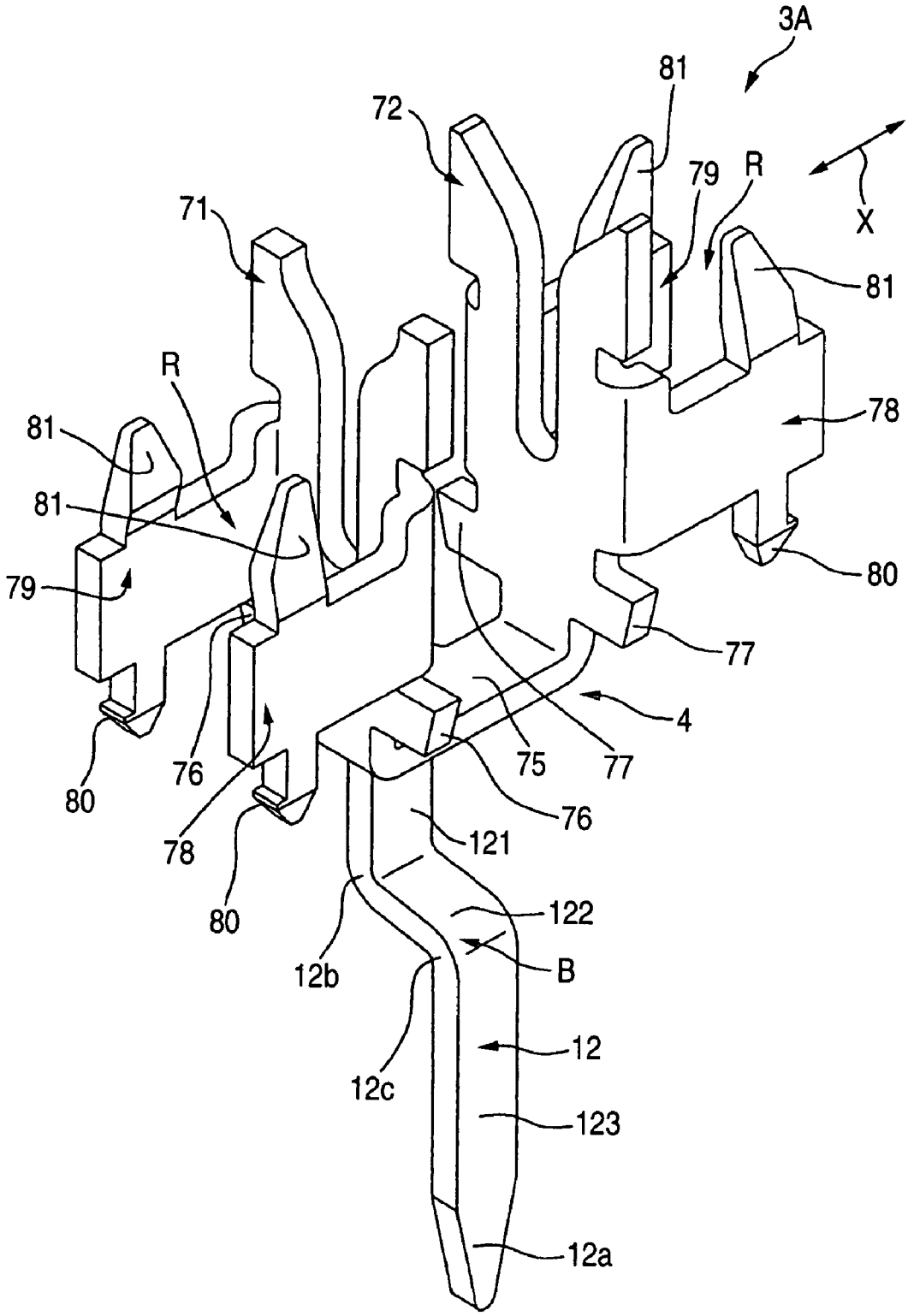
FIG. 13 is a perspective view showing an example of a modified insulation displacement terminal.

In this embodiment, for assembling the board-containing insulation displacement connector 1, first, the insulation displacement terminals 3 are mounted in the main housing 6 as shown in FIGS. 11(*a*) and 11(*b*), and the body 4 of each insulation displacement terminal 3 is fixed to the terminal holding portion 5 of the main housing 6 by the use of the retaining projections 76, 77 and 80, and also the lead 12 is passed through the passage hole 14 in the bottom plate 13 of the main housing 6, and is extended into the second holding space 11 as shown in FIG. 9.

Then, the circuit board 10, having the group of circuit components beforehand mounted thereon, is introduced into the second holding space 11, and after the leads 12 are passed respectively through the passage holes 15 in the circuit board 10, the distal ends 12*a* of the leads 12 are soldered as shown in FIG. 10.

Then, the second cover housing 8 is combined with the main housing 6 to hold the circuit board 10 within the second holding space 11, thereby forming a sub-assembly. In this sub-assembly condition, the insulation displacement terminals 3 are connected by insulation displacement, for example, with desired portions of the insulated wires (serving as feed wires), respectively, thus completing the assembling of the board-containing insulation displacement connector 1.

In this embodiment described above, as shown in FIG. 8, the wire is connected by insulation displacement with the insulation displacement grooves 73 of the insulation displacement groove-forming portions 71 and 72 in a double manner while the insulation of the wire is cut by these insulation displacement grooves 73, and therefore the reliability can be enhanced. Moreover, the plate portions 78 and 79 are formed by bending respectively at the opposite side edges of the first insulation displacement groove-forming portion 71 to provide the holding space R for the insulated wire, and therefore the overall length of the insulation displacement terminal 3 as well as its width can be made much smaller.

In addition, by bending the bendable piece portions 81 extending respectively from the upper edges 78*b* and 79*b* of the plate portions 78 and 79, the insulated wire 2 can be confined and held in the holding space R defined by the bottom portion of the terminal holding portion 5 of the main housing 6 and the pair of plate portions 78 and 79. This portion can be formed into a compact structure as compared with a conventional insulating barrel of a generally trough-shape.

The retaining projections 80, extending respectively from the lower edges 78*a* and 79*a* of the plate portions 78 and 79, are retainingly engaged respectively in the retaining holes 85 in the main housing 6, and therefore when bending the bendable piece portions 81, the plate portions 78 and 79 will not be displaced out of position, so that the insulation of the insulated wire 2 can be positively held.

The retaining projections 76, 77, formed respectively at the opposite side edges of each of the first and second insulation displacement groove-forming portions 71 and 72, are retainingly engaged respectively in the vertical grooves 83, 84 formed in the main housing 6, and therefore the first and second insulation displacement groove-forming portions 71 and 72 can be firmly joined to the main housing 6, and an insulation displacement load, produced when carrying out the insulation displacement operation within the main housing, can be more positively received by the main housing 6.

When the insulation displacement operation is carried out within the main housing 6, the bent portion B (serving as the deformable portion) of the lead 12 is resiliently deformed, and therefore the insulation displacement load is prevented from inadvertently acting on the solder portion S at the distal end of the lead 12 and other portions. Therefore, this is quite suited for the insulation displacement within the housing.

In the sub-assembly condition in which all parts except the first cover housing 7 are assembled together, each terminal can be connected by insulation displacement with a desired portion of the so-called insulated wire 2, and therefore the degree of freedom is high. Particularly, this structure can be suitably used in the wiring of an LAN (Local Area Network) between various ECUs in a vehicle such as an automobile.

Particularly, the insulation displacement load can be received by the receiving portion 44 of the second cover housing 8 through the bottom plate 13 of the main housing 6 and the circuit board 10, and therefore the bottom plate 13 and the circuit board 10 will not be accidentally bent, so that the positive insulation displacement can be achieved. Therefore, it becomes substantially possible to carry out the so-called in-housing insulation displacement.

The receiving portion 44 for receiving the load during the insulation displacing is provided at the box-like portion 43 of the second cover housing 8 which is excellent in strength, as shown in FIG. 7, and therefore this receiving portion can positively receive the insulation displacement load, so that the positive insulation displacement can be achieved.

The circuit board 10 is held between the rib 46 of the bottom plate 13 of the main housing 6 and the rib 41 of the second cover housing 8 as shown in FIG. 3, and therefore the circuit board 10 is positively prevented from being accidentally bent by the insulation displacement load.

Furthermore, even if a load should act on the lead 12 during the insulation displacing, the crank-like bent portion B of the lead 12 as shown in FIG. 10 is resiliently deformed to absorb this load, and therefore the unnecessary load will not act on the solder portion S. The load, produced during the insulation displacing, can be positively absorbed by the simple structure provided at the lead 12.

In the insulation displacement terminal 3 of the embodiment of FIG. 8, although the plate portions 78 and 79 extend only from the first insulation displacement groove-forming portion 71, the invention is not limited to this structure, and plate portions 78 and 79 for forming a holding space R can also be formed by bending on the second insulation displacement groove-forming portion 72 to extend therefrom, in which case the insulated wire 2 can be more positively held.

In addition, the present invention is not limited to the above embodiment, and for example the second projections 68 can be formed on the main housing 6 while the fitting holes 69 can be formed in the first cover housing 7. And besides, the provision of the second bent portion 20 can be omitted. Furthermore, various modifications can be made within the scope of the claims of the invention.

INDUSTRIAL APPLICABILITY

In the present invention, it is possible to provide the insulation displacement terminal which is compact, and has a high connection reliability.

The invention claimed is:

1. An insulation displacement terminal comprising:

a pair of opposed insulation displacement groove-forming portions each having an insulation displacement groove for displacing an insulation;

an interconnecting portion interconnecting bottom portions of said pair of insulation displacement groove-forming portions;

a lead extending from said interconnecting portion; and a pair of plate portions which are formed respectively at opposite side edges of at least one of said insulation displacement groove-forming portions by bending to form an insulated wire-holding space therebetween, wherein the terminal is formed into an integral construction by sheet metal working, using a single member; and abutment portions are formed respectively at lower edges of said plate portions so as to be abutable against a housing and bendable piece portions extending respectively from upper edges of said plate portion.

2. The insulation displacement terminal according to claim 1, wherein each of said plate portions includes a retaining portion for retaining engagement with said housing.

3. An insulation displacement terminal comprising:

a pair of opposed insulation displacement groove-forming portions each having an insulation displacement groove for displacing an insulation;

an interconnecting portion interconnecting bottom portions of said pair of insulation displacement groove-forming portions;

a lead extending from said interconnecting portion;

a pair of plate portions which are formed respectively at opposite side edges of at least one of said insulation displacement groove-forming portions by bending to form an insulated wire-holding space therebetween, wherein the terminal is formed into an integral construction by sheet metal working, using a single member; and retaining portions respectively formed on opposite side edges of said pair of insulation displacement groove-forming portions so as to be retainingly engaged with said housing.

4. The insulation displacement terminal according to claim 1, further comprising a bent portion provided at an intermediate portion of said lead, and being resiliently deformable.

5. The insulation displacement terminal according to claim 1, wherein said terminal is used in an insulation displacement connector containing a circuit board, and said lead is soldered to said circuit board.

* * * * *

UNITED STATES PATENT AND TRADEMARK OFFICE

CERTIFICATE OF CORRECTION

PATENT NO. : 7,021,956 B2
APPLICATION NO. : 10/501396
DATED : April 4, 2006
INVENTOR(S) : Goto et al.

It is certified that error appears in the above-identified patent and that said Letters Patent is hereby corrected as shown below:

On the title page, Item (22), the International Filing Date is incorrect. Item (22) should read:

-- (22) PCT Filed: Nov. 21, 2003 --

Signed and Sealed this

Fifteenth Day of August, 2006

JON W. DUDAS
*Director of the United States Patent and Trademark Office*